US005838209A

United States Patent [19]

Okada et al.

[11] Patent Number: 5,838,209

[45] Date of Patent: Nov. 17, 1998

[54] NONRECIPROCAL JUNCTION CIRCUIT ELEMENT HAVING DIFFERENT CONDUCTOR INTERSECTING ANGLES

[75] Inventors: Takekazu Okada, Ishikawa-ken; Takashi Hasegawa; Hiromu Tokudera, both of Nagaokakyo, all of Japan

[73] Assignee: Murata Manufacturing Co., Ltd., Japan

[21] Appl. No.: 975,773

[22] Filed: Nov. 21, 1997

Related U.S. Application Data

[63] Continuation of Ser. No. 681,849, Jul. 29, 1996, Pat. No. 5,745,014.

[30] Foreign Application Priority Data

Jul. 31, 1995 [JP] Japan ..... 7-195030
Dec. 27, 1995 [JP] Japan ..... 7-341374

[51] Int. Cl.[6] ..... H01P 1/36; H01P 1/383

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 3,555,459 | 1/1971 | Anderson | 333/1.1 |
| 3,573,665 | 4/1971 | Knerr | 333/1.1 |
| 3,621,477 | 11/1971 | Bosma | 333/1.1 |

*Primary Examiner*—Paul Gensler
*Attorney, Agent, or Firm*—Ostrolenk, Faber, Gerb & Soffen, LLP

[57] ABSTRACT

A nonreciprocal circuit element having low insertion loss is provided. In the circuit element, three central conductors are disposed such that they intersect each other at specified angles in an electrically isolated condition and a DC bias magnetic field is applied to the intersection. The intersection angles formed by the central conductors are set to different values, corresponding to the rotation angle of the high-frequency magnetic field caused by the DC bias magnetic field. A stronger operating DC magnetic field than that in a conventional circuit element is used to reduce a ferrite loss.

10 Claims, 8 Drawing Sheets

NONRECIPROCAL JUNCTION CIRCUIT ELEMENT HAVING DIFFERENT CONDUCTOR INTERSECTING ANGLES

This is a Continuation of application Ser. No. 08/681,849, filed Jul. 29, 1996, now U.S. Pat. No. 5,745,014.

BACKGROUND OF THE INVENTION

1. Field of the Invention

The present invention relates to nonreciprocal circuit elements employed as high-frequency circuit components in the microwave band, such as isolators and circulators.

2. Description of the Related Art

Microwave lumped-constant isolators and circulators have characteristics in which attenuation of a signal is very low in the direction of the signal propagation, and it is very high in the reverse direction. They are employed in transmitting and receiving circuits or the like of equipment such as portable telephones and mobile telephones. As shown in FIG. 11, one known circulator is formed with three central conductors 30 which are disposed so that they intersect each other at a specified angle in an electrically isolated condition, one end of each of the central conductors 30 is connected to a matching capacitor C, and the other end is connected to the ground, and a ferrite body 31 is placed at the intersection of the central conductors 30 so as to receive a DC magnetic field supplied from a magnet (not shown) provided in a casing of the circuit element. On the basis of the Faraday effect, an electromagnetic wave inputted into a central electrode is outputted at the intersection. The output angle depends on the strength of the DC magnetic field.

An isolator is formed in the same way, with a terminating resistor connected to one of the ports of the central conductors. In a conventional isolator or circulator, the angle formed by any two of the central conductors 30 is set to 120 degrees with an actual machining tolerance of 1 degree.

The above-described central conductors may be metal conductors wounded on a ferrite body, electrode patterns formed on a dielectric substrate by means of etching and connected by through holes provided in the substrate, or electrode patterns in a dielectric or magnetic ceramic formed by printing electrode patterns on a ceramic green sheet, laminating a plurality of the sheets and sintering the laminated body.

When the three central conductors are disposed with an intersection angle of 120 degrees, since the three ports operate in the same way, the device is symmetrical in terms of its characteristics. However, this intersection angle is not preferable from the view point of reducing insertion loss.

Generally, in the high-frequency region, positive and negative permeabilities of a circularly polarized wave $\mu+$, $\mu-$ are expressed by the following equations:

$$\mu+=\mu+'+j\mu+''$$

$$\mu-=\mu-'+j\mu-''$$

where $\mu+'$ is a real part of the positive permeability of the circularly polarized wave, $\mu+''$ is an imaginary part of the permeability of the circularly polarized wave, $\mu-'$ is a real part of the negative permeability of the circularly polarized wave and $\mu-''$ is an imaginary part of the negative permeability of the circularly polarized wave. In these equations, imaginary parts are called loss terms.

Values $\mu+'$, $\mu+''$, $\mu-'$ and $\mu-''$ vary depending on the strength of the DC magnetic field as shown in FIG. 12. The amount of $\mu-''$ is very small over a wide range of the magnetic field strength.

The above mentioned output angle depends on the difference between $\mu+'$ and $\mu-'$. At a magnetic field strength HO, an output angle of 120 degrees is realized. In other words, when using a non-reciprocal circuit element in which the angle between individual electrodes is 120 degrees, it is necessary to apply a magnetic field having strength HO.

On the other hand, a ferrite loss is defined by $\mu+''-\mu-''$. The loss becomes relatively large at the magnetic field strength HO. Thus, the insertion loss of the circuit element is relatively large when using 120 degrees as the intersecting angle of the central electrodes.

SUMMARY OF THE INVENTION

In view of this problem, it is an object of the present invention to provide a nonreciprocal circuit element which realizes a low insertion loss and assures desired electrical characteristics by setting the intersection angle of the central conductors corresponding to the rotation angle of the high-frequency magnetic field caused by a given DC bias magnetic field.

The foregoing object is achieved in one aspect of the present invention through the provision of a nonreciprocal circuit element in which three central conductors are disposed such that they intersect each other at the specified angles in an electrically isolated condition and a DC magnetic field is applied to the intersection, wherein one of the three intersection angles formed by the intersection of the three central conductors is set to a value different from the other two intersection angles.

The nonreciprocal circuit element may be configured such that the other two intersection angles are set to different values.

The nonreciprocal circuit element may be configured such that the other two intersection angles are set to the same value.

The nonreciprocal circuit element may be configured such that at least one intersection angle is set to more than 120 degrees.

As indicated in FIG. 6, insertion loss can be reduced as the intersection angle of the central conductors is increased.

On the other hand, the strength of the DC bias magnetic field which should be applied to a circuit element, is proportional to the intersection angle. Thus, when setting the angle which realizes low insertion loss, it is necessary to increase the strength of the DC magnetic field.

However, the maximum value of DC magnetic field is restricted by the size of the magnet. Therefore, in a rectangular-parallelepiped-shaped circulator having dimensions of 5.0×4.5×2.5 mm, for example, the maximum magnetic field is about 1130 G. In this case, it is desirable to set the intersection angle of central conductors to 150 degrees to minimize the insertion loss.

Especially in a transmitting and receiving circuit employed in a portable telephone or the like, since the life time of a battery can be extended as power consumption becomes lower, it is desirable that devices used in the circuit have low loss to suppress power consumption. Therefore, it is important that isolators and circulators employed in the transmitting and receiving circuit have as low loss as possible.

According to a nonreciprocal circuit element of the present invention, since the intersection angles of the central conductors are not set to the same value but set to the values corresponding to the rotation angle of the high-frequency magnetic field caused by the DC bias magnetic field, insertion loss is reduced, power consumption is suppressed, and the device can be made compact.

The features of the invention, as well as other objects, uses and advantages thereof, will clearly appear from the following description and from the accompanying drawings in which like numerals refer to like or corresponding components.

DETAILED DESCRIPTION OF THE PREFERRED EMBODIMENTS

Embodiments of the present invention will be described below by referring to the accompanying drawings.

Figure 1:
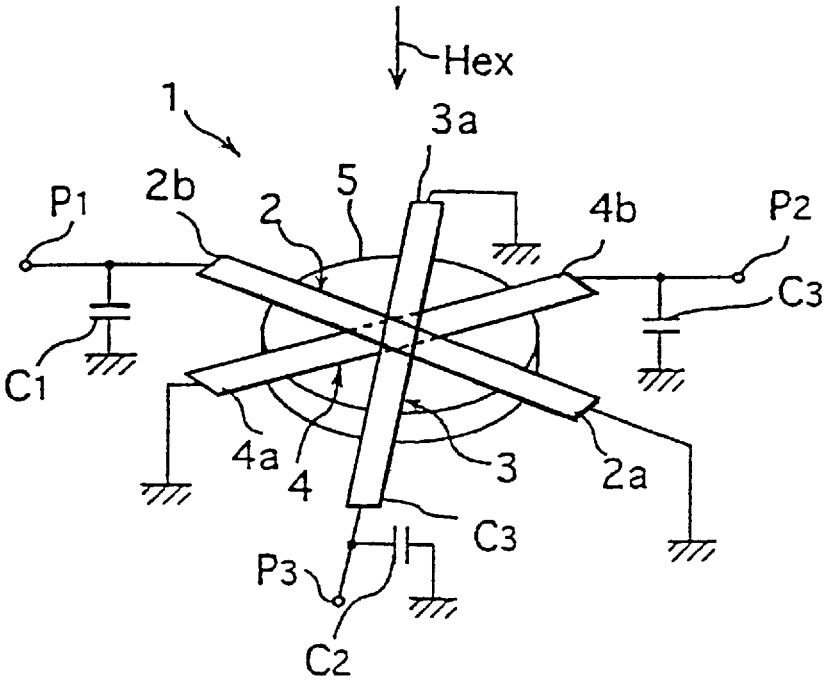
FIG. 1 is an equivalent circuit diagram showing a circulator according to a first embodiment of the present invention.

In FIG. 1, a lumped-constant circulator 1 employed in the microwave band is formed such that first to third central conductors 2, 3, and 4 are disposed so that they intersect each other in an electrically isolated condition, a ferrite body 5 is at the intersection of the central conductors 2 to 4 at one main surface, and a DC bias magnetic field Hex is applied to the intersection by a permanent magnet (not shown in the figure). The central conductors 2 to 4, the ferrite body 5, and the permanent magnet are accommodated in a magnetic-substance yoke constituting a magnetic closed circuit (not shown).

One end 2*a*, 3*a*, or 4*a* of each of the central conductors 2 to 4 is connected to the ground and the other end is connected to an input/output port P1, P2, or P3, respectively. Matching capacitors C1, C2, and C3 are connected to the ports P1 to P3 in parallel.

Figure 2:
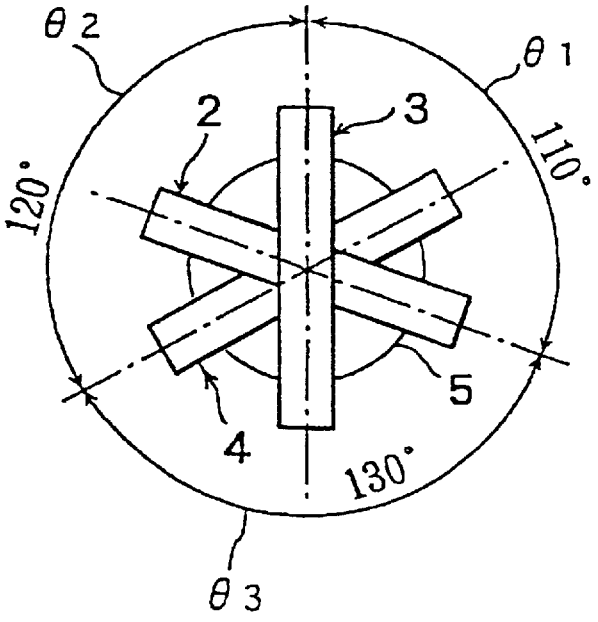
FIG. 2 is a view showing the intersection angles between central electrodes of the circulator indicated in FIG. 1.

The angles θ1 to θ3, shown in FIG. 2, formed by two of the central conductors 2 to 4 are set as follows. The angle θ1 formed by the first conductor 2 and the second conductor 3 is set to 110 degrees. The angle θ2 formed by the second conductor 3 and the third conductor 4 is set to 120 degrees. The angle θ3 formed by the third conductor 4 and the first conductor 2 is set to 130 degrees.

In the circulator 1 according to this embodiment, among the intersection angles θ1 to θ3 of the central conductors 2 to 4, only θ2 is set to 120 degrees, θ1 is set to 110 degrees, and θ3 is set to 130 degrees. Therefore, the insertion loss between the third central conductor 4 and the first central conductor 2, which form θ3, is improved. This suppresses power consumption to extend the life time of the battery and also allows the device to be compact. It is preferred that a higher DC bias magnetic field than a conventional one be applied to the ferrite body 5. With this setting, the ferrite loss is suppressed by operating the device in a condition where the magnetic field is strong, i.e. the value of $\mu$+" is low.

Figure 3:
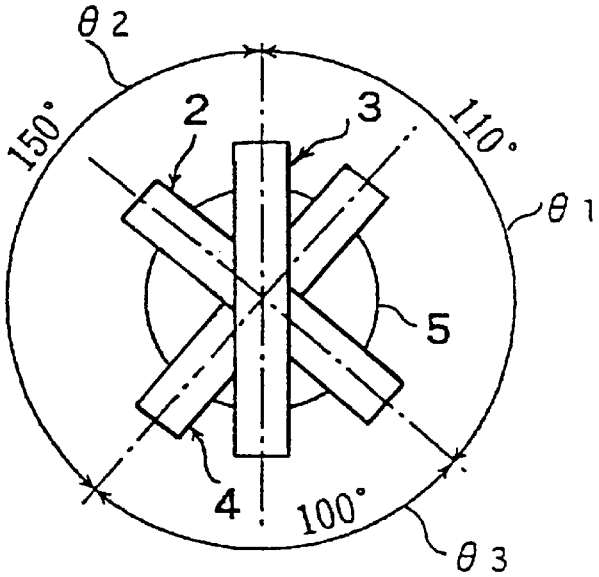
FIG. 3 is a view showing another set of intersection angles according to a second embodiment of the present invention.
Figure 4:
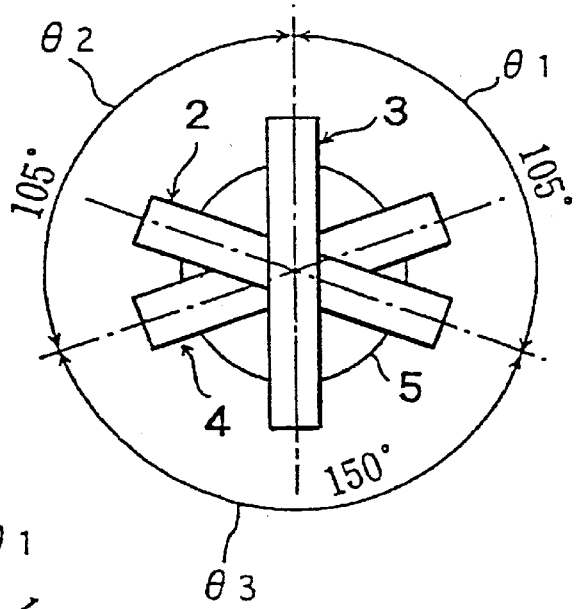
FIG. 4 is a view showing still another set of intersection angles according to a third embodiment of the present invention.
Figure 5:
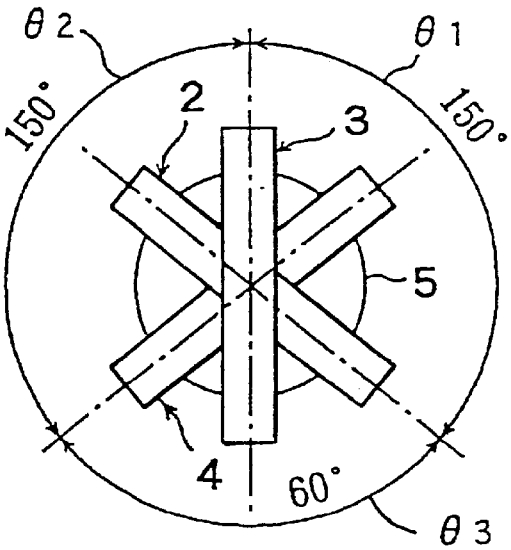
FIG. 5 is a view showing a further set of intersection angles according to a fourth embodiment of the present invention.

FIGS. 3 to 5 are views showing the intersection angles of central conductors according to other embodiments. The same symbols as those used in FIG. 2 correspond to the same or corresponding sections.

In FIG. 3, the angle θ1 formed by the first central conductor 2 and the second central conductor 3 is set to 110 degrees. The angle θ2 formed by the second conductor 3 and the third conductor 4 is set to 150 degrees. The angle θ3 formed by the third conductor 4 and the first conductor 2 is set to 100 degrees. With this configuration, the intersection angles θ1 to θ3 are all set to angles different from 120 degrees.

In FIG. 4, the angle θ1 formed by the first central conductor 2 and the second central conductor 3 and the angle θ2 formed by the second conductor 3 and the third conductor 4 are set to 105 degrees. The angle θ3 formed by the third conductor 4 and the first conductor 2 is set to 150 degrees.

In FIG. 5, the angle θ1 formed by the first central conductor 2 and the second central conductor 3 and the angle θ2 formed by the second conductor 3 and the third conductor 4 are set to 150 degrees. The angle θ3 formed by the third conductor 4 and the first conductor 2 is set to 60 degrees. With this configuration, the intersection angles θ1 to θ3 are all set to angles different from 120 degrees, and θ1 and θ2 are set to the same value.

Figure 6:
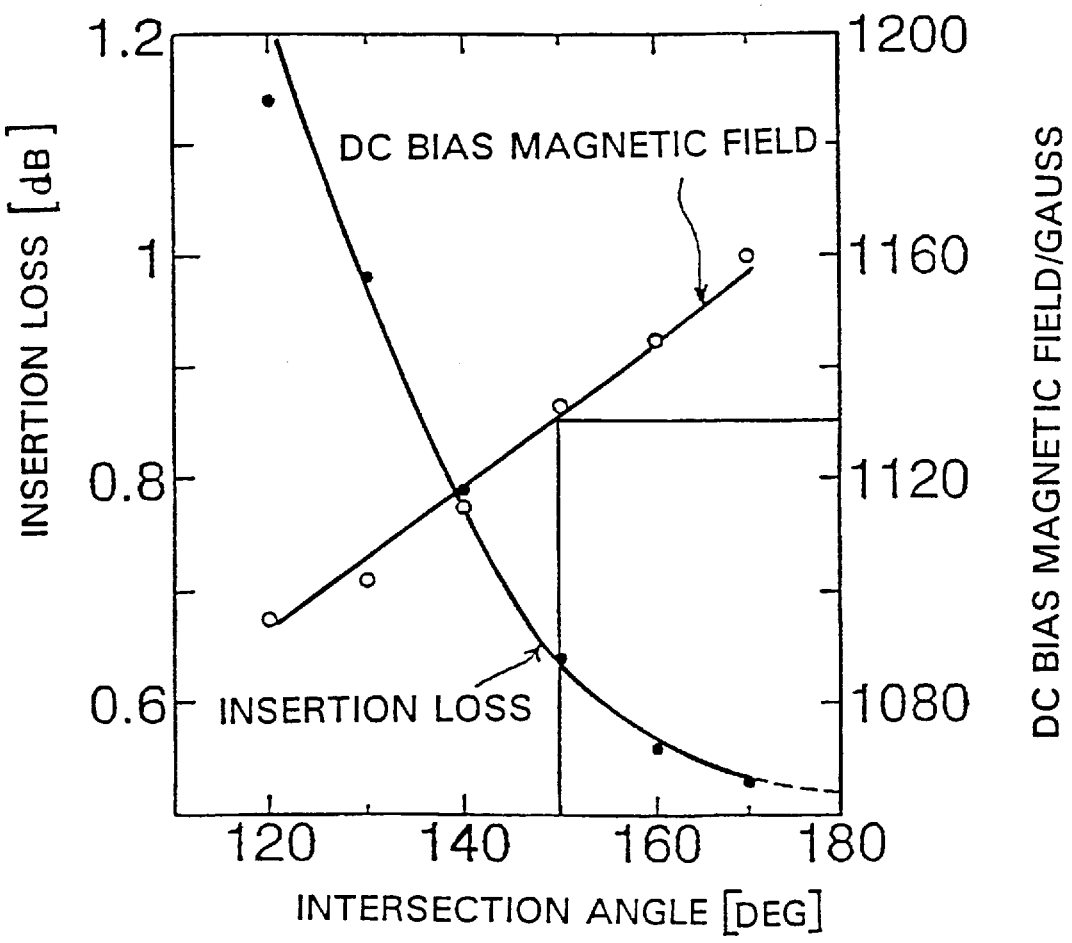
FIG. 6 is a graph showing the relationship between intersection angle, insertion loss, and DC bias magnetic field strength.

As indicated in FIG. 6, insertion loss can be reduced as the insertion angle of the central conductors is increased.

On the other hand, the strength of the DC bias magnetic field which should be applied to a circuit element, is proportional to the intersection angle. Thus, when setting the angle which realizes low insertion loss, it is necessary to increase the strength of the DC magnetic field.

Figure 7A:
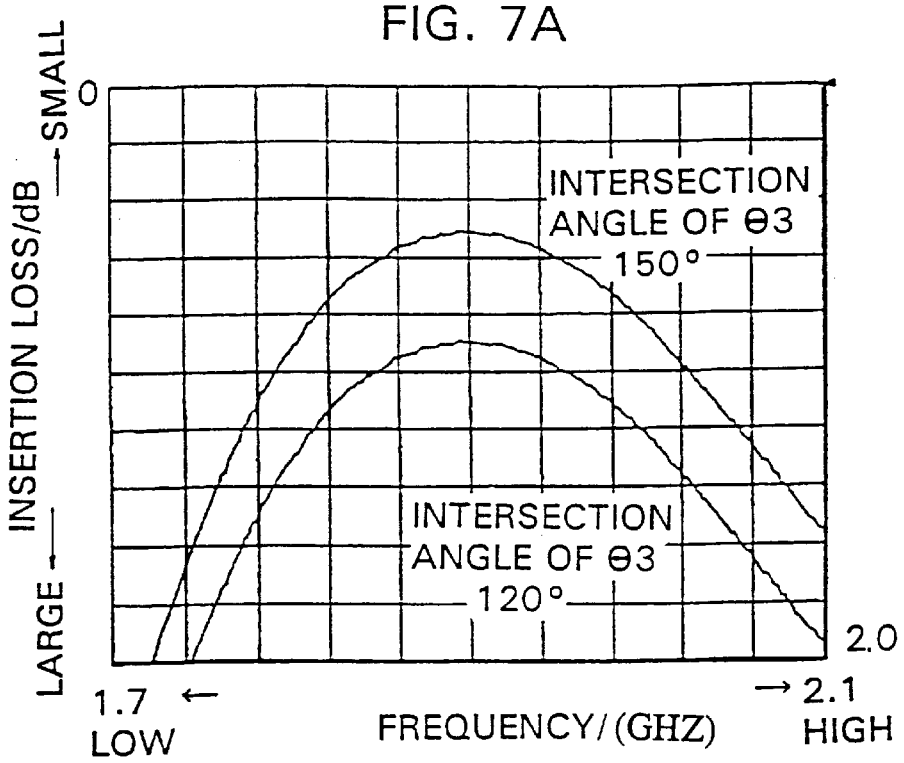
FIG. 7A is a graph showing insertion loss vs. frequency of input electromagnetic wave in reciprocal circuit elements having intersection angle θ3=120 degrees and 150 degrees respectively.

FIG. 7A shows the effect of the present invention. When the intersection angle θ3 is increased insertion loss is reduced over a wide range of frequencies in comparison with a conventional case in which the angle θ3 is 120 degrees.

Figure 7B:
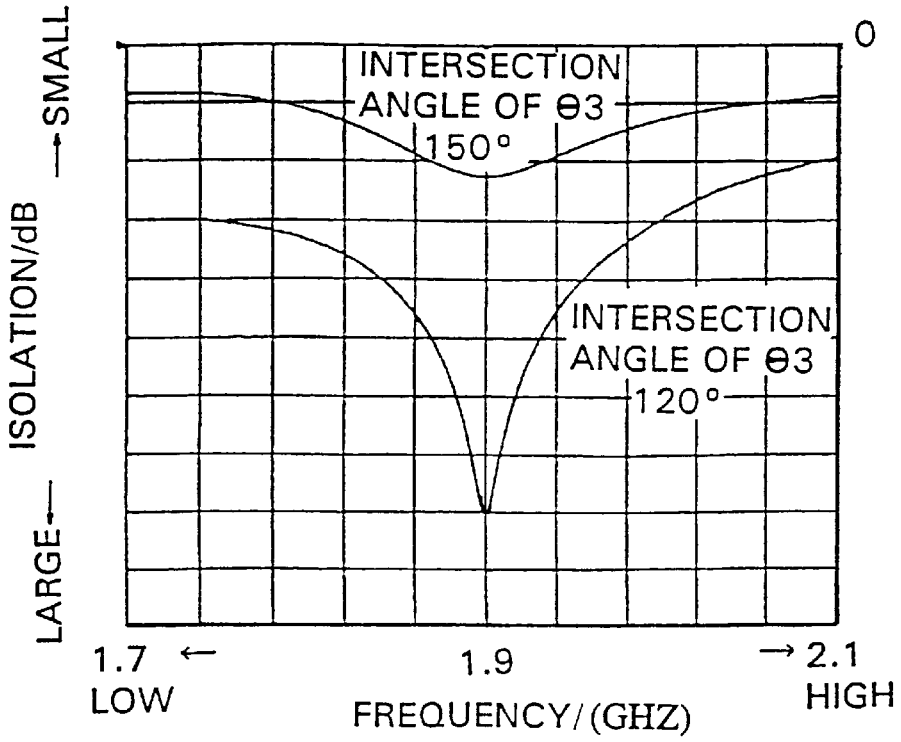
FIG. 7B is a graph showing isolation characteristic vs. frequency of input electromagnetic wave in reciprocal circuit elements having intersection angle θ3=120 degrees and 150 degrees respectively.
Figure 10:
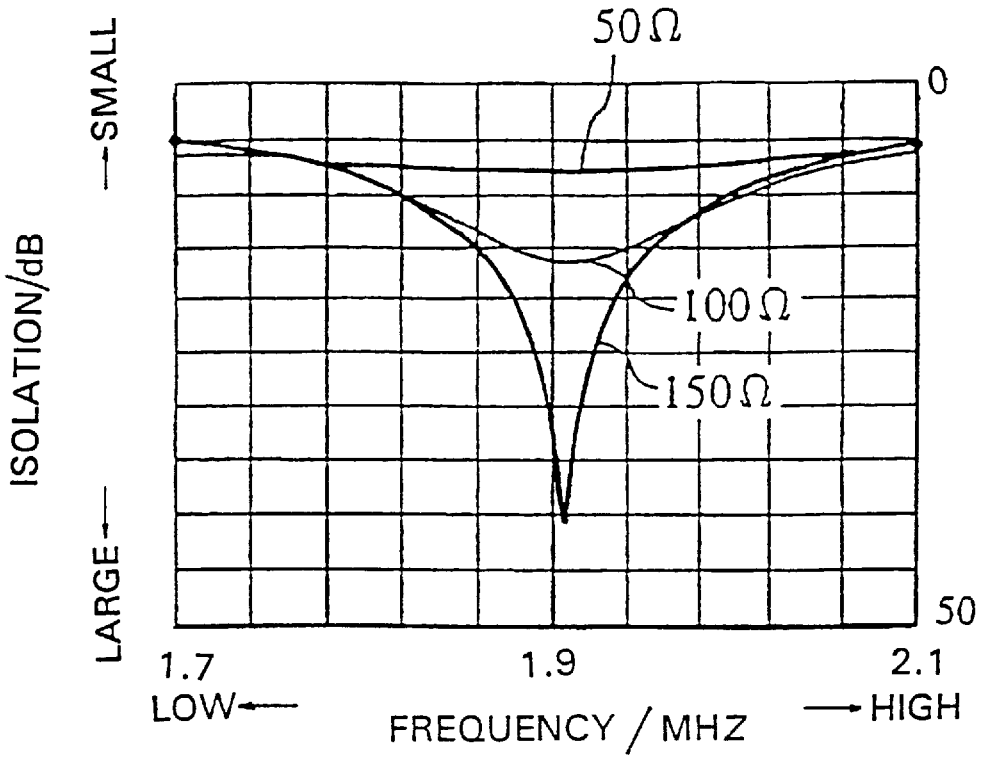
FIG. 10 is a characteristics chart indicating the relationship between the resistance of the terminating resistor in the isolator and the isolation characteristics.
Figure 12:
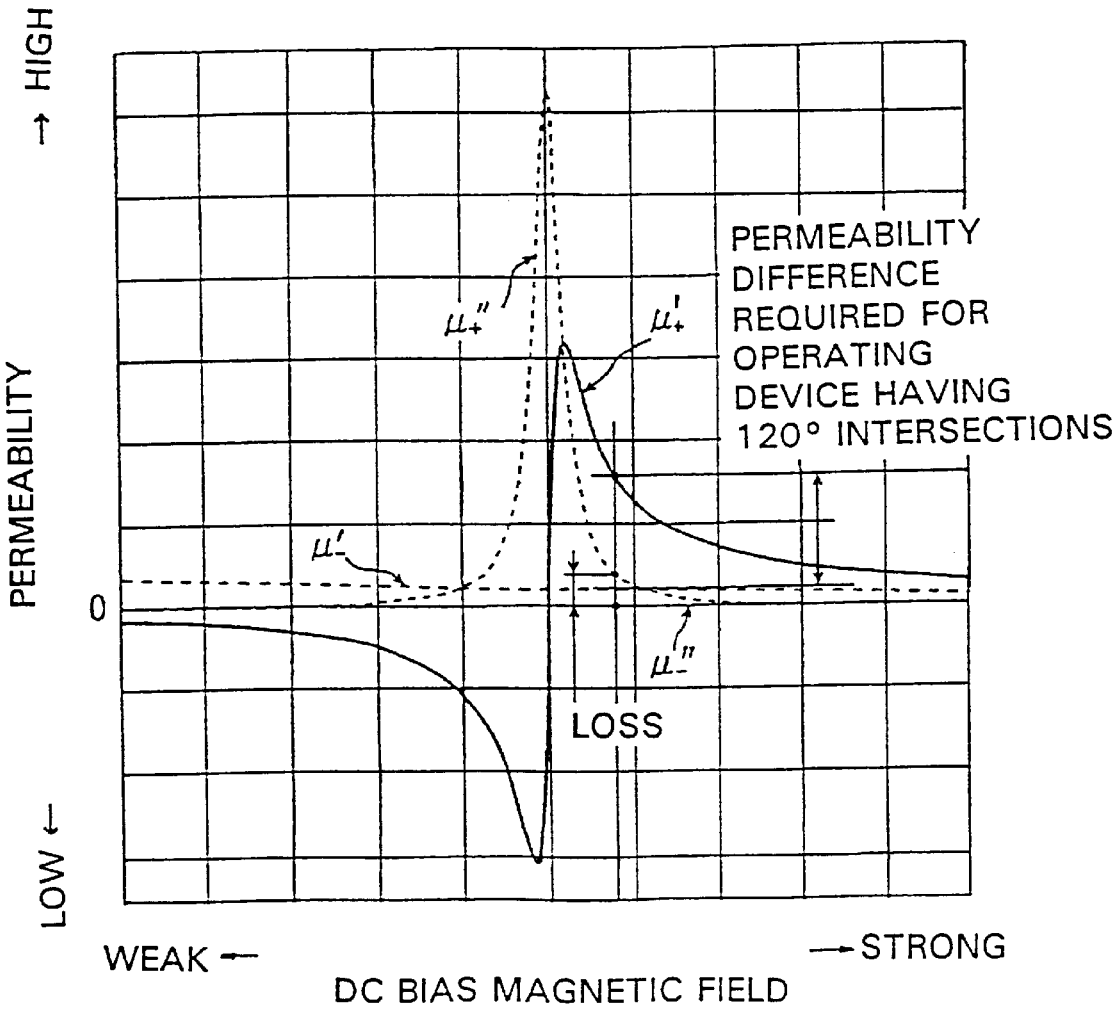
FIG. 12 PRIOR ART
FIG. 12 is a chart indicating a relation between permeability of a circularly polarized wave through a ferrite body and strength of a DC bias magnetic field applied to the ferrite body.

On the contrary, as shown in FIG. 7B, isolation in case of θ3=150 degrees is smaller than that of the conventional 120 degrees configuration. However, as described later, the isolation characteristic can be improved by using appropriate terminal resistors whose effects are indicated in FIG. 10.

Figure 8:
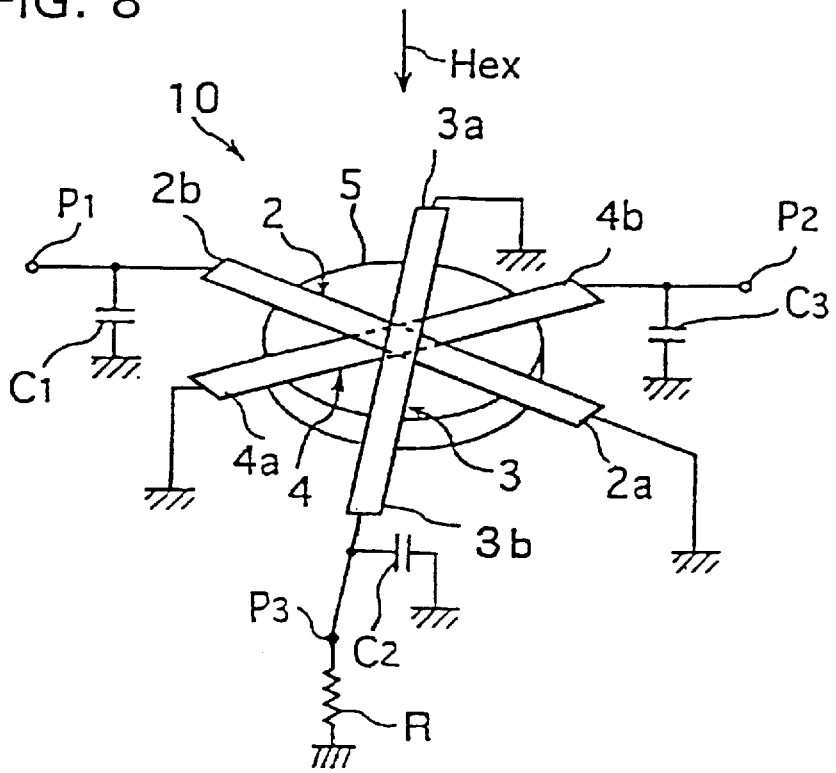
FIG. 8 is an equivalent circuit diagram showing an isolator according to a fifth embodiment of the present invention.
Figure 11:
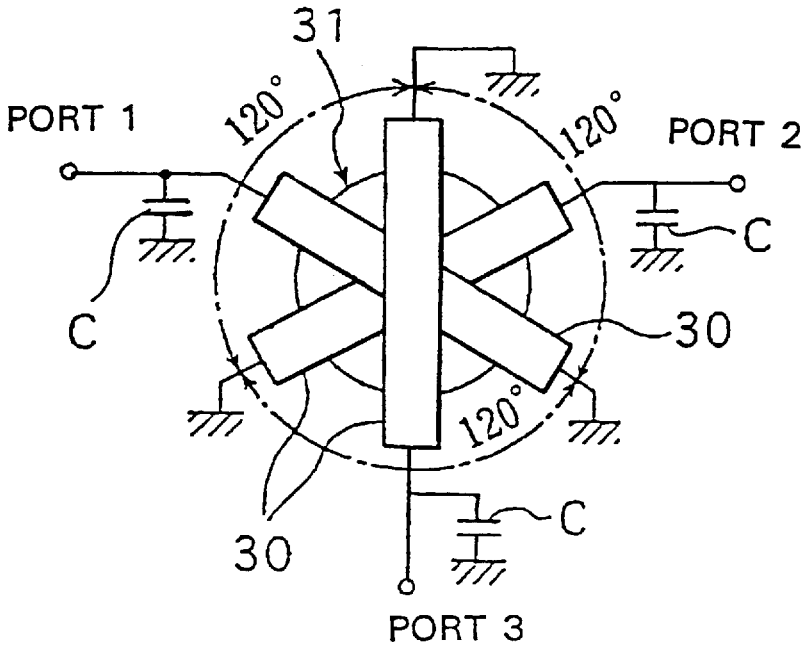
FIG. 11 PRIOR ART
FIG. 11 is an equivalent circuit diagram of a conventional, general circulator.

In the above embodiments, circulators are used as examples. However, the present invention can also be applied to an isolator as shown in FIG. 8. The same symbols as those used in FIG. 1 indicate the same or corresponding portions.

In an isolator 10, a nonreflective, terminating resistor R is connected to a port P3. With this configuration, a signal from a port P1 is transferred to a port P2, and reflection wave input from the port P2 is absorbed by the terminating resistor R. In the isolator 10, substantially the same advantages as in the above embodiments can be obtained by changing the intersection angles of the central conductors 2 to 4.

By changing the intersection angles of the central conductors 2 to 4 in the isolator 10, the insertion loss characteristics can be improved. However, the isolation may be reduced. This is because the impedances change as the intersection angles change. To solve this problem, it is effective to change the resistance of the terminating resistor R.

Figure 9:
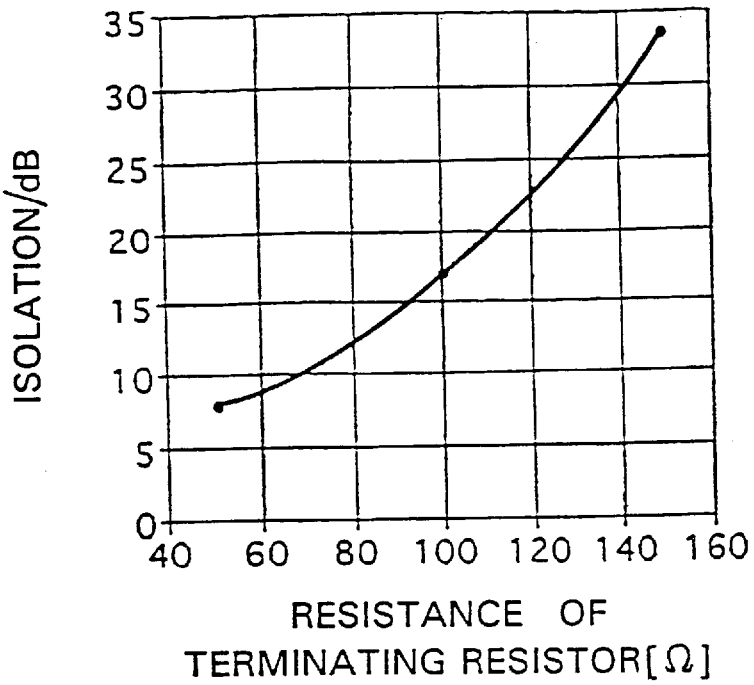
FIG. 9 is a characteristics chart indicating the relationship between the resistance of the terminating resistor in the isolator and the isolation characteristics.

FIGS. 9 and 10 are characteristics charts showing the relationship between the resistance of the terminating resistor and the isolation characteristics in the isolator 10. As shown in the figures, the isolation characteristics can be improved by making the resistance of the terminating resistor larger than a conventional value, 50Ω. When the resistance of the terminating resistor is set to 100Ω, for example, the isolation level is 17 dB. When the resistance is set to 150Ω, the isolation level is 33 dB. The attenuation characteristics are improved.

In the above embodiments, a circulator or an isolator for use in communication equipment are described. However, it can be clearly understood that the method of determining an intersection angle, the strength of a DC bias magnetic field, and the resistance of the terminal resistor to obtain low insertion loss while maintaining high isolation, may be applied to various types of nonreciprocal circuit elements.

While a particular embodiment of the present invention has been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method of producing a nonreciprocal circuit element comprising the steps of:

providing a ferrite body;

providing three central conductors such that said conductors intersect each other at predetermined angles in an electrically isolated condition, wherein all three of the intersection angles formed by the intersection of said three central conductors have different values;

providing a terminating resistor electrically connected to at least one of said three central conductors thereby providing an isolator, and setting the resistance of said terminating resistor to greater than 50 ohms so as to provide isolation; and applying a DC magnetic field to the ferrite body.

2. A method according to claim 1, further comprising the step of adjusting said intersection angles so as to reduce insertion loss.

3. A method of producing a nonreciprocal circuit element comprising the steps of:

providing a ferrite body;

providing three central conductors such that said conductors intersect each other at predetermined angles in an electrically isolated condition, wherein all three of the intersection angles formed by the intersection of said three central conductors have different values, at least one of said intersection angles being more than 120 degrees;

providing a terminating resistor electrically connected to at least one of said three central conductors thereby providing an isolator, and setting the resistance of said terminating resistor to greater than 50 ohms so as to provide isolation; and applying a DC magnetic field to the ferrite body.

4. A method according to claim 3, further comprising the step of adjusting said intersection angles so as to reduce insertion loss.

5. A nonreciprocal circuit element comprising:

a ferrite body;

three central conductors which are disposed such that they intersect each other at predetermined angles in an electrically isolated condition, wherein all three of the intersection angles formed by the intersection of said three central conductors have different values;

a DC magnetic field being applied to the intersection and to the ferrite body; and a terminating resistor electrically connected to at least one of said three central conductors thereby providing an isolator, wherein the resistance of said terminating resistor is greater than 50 ohms.

6. A nonreciprocal circuit element comprising:

a ferrite body;

three central conductors which are disposed such that they intersect each other at predetermined angles in an electrically isolated condition, wherein all three of the intersection angles formed by the intersection of said three central conductors have different values, at least one of said intersection angles being more than 120 degrees;

a DC magnetic field being applied to the intersection and to the ferrite body; and a terminating resistor electrically connected to at least one of said three central conductors thereby providing an isolator, wherein the resistance of said terminating resistor is greater than 50 ohms.

7. A method of producing a nonreciprocal circuit element comprising the steps of:

providing a ferrite body;

providing three central conductors such that said conductors intersect each other at predetermined angles in an electrically isolated condition, one of the three intersection angles formed by the intersection of said three central conductors being set to a value different from the other two intersection angles, wherein said three intersection angles are 110, 120 and 130 degrees, respectively; and applying a DC magnetic field to the ferrite body.

8. A method of producing a nonreciprocal circuit element comprising the steps or:

providing a ferrite body;

providing three central conductors such that said conductors intersect each other at predetermined angles in an electrically isolated condition, one of the three intersection angles formed by the intersection of said three central conductors being set to a value different from the other two intersection angles, wherein said three intersection angles are 100, 110 and 150 degrees, respectively; and applying a DC magnetic field to the ferrite body.

9. A method of producing a nonreciprocal circuit element comprising the steps of:

providing a ferrite body;

providing three central conductors such that said conductors intersect each other at predetermined angles in an electrically isolated condition, one of the three intersection angles formed by the intersection of said three central conductors being set to a value different from the other two intersection angles, wherein one of the angles is about 150 degrees, and the other two angles are about 105 degrees respectively; and applying a DC magnetic field to the ferrite body.

10. A method of producing a nonreciprocal circuit element comprising the steps of:

providing a ferrite body;

providing three central conductors such that said conductors intersect each other at predetermined angles in an electrically isolated condition, one of the three intersection angles formed by the intersection of said three central conductors being set to a value different from the other two intersection angles, wherein said three intersection angles are 150, 150 and 60 degrees, respectively; and applying a DC magnetic field to the ferrite body.

* * * * *